US006530509B1

(12) United States Patent
Davis

(10) Patent No.: US 6,530,509 B1
(45) Date of Patent: Mar. 11, 2003

(54) WEARABLE CASE FOR WRITING MATERIALS

(76) Inventor: Ula D. Davis, 19362 Sandhill La., Flint, TX (US) 75762

( * ) Notice: Subject to any disclaimer, the term of this patent is extended or adjusted under 35 U.S.C. 154(b) by 0 days.

(21) Appl. No.: 09/427,681

(22) Filed: Oct. 27, 1999

Related U.S. Application Data

(60) Provisional application No. 60/120,752, filed on Feb. 18, 1999.

(51) Int. Cl.[7] ..... A45F 3/14
(52) U.S. Cl. ..... 224/219; 224/221; 224/222
(58) Field of Search ..... 224/219, 221, 224/222, 267, 176

(56) References Cited

U.S. PATENT DOCUMENTS

| | | | | | |
|---|---|---|---|---|---|
| 259,076 | A | | 6/1882 | Bainbridge | |
| 362,106 | A | | 5/1887 | Pember et al. | |
| 433,536 | A | | 8/1890 | Murdock | |
| 1,407,239 | A | * | 2/1922 | Weiss | 108/43 |
| 1,485,915 | A | * | 3/1924 | Hammel | 224/219 |
| 1,594,215 | A | * | 7/1926 | Sides | 206/371 |
| 1,609,481 | A | * | 12/1926 | McCarthy et al. | 224/219 |
| 1,701,595 | A | * | 2/1929 | Taylor | 206/81 |
| 1,823,814 | A | * | 9/1931 | Aiello | 132/301 |
| 3,202,331 | A | * | 8/1965 | McKinstrie | 224/221 |
| 3,828,696 | A | * | 8/1974 | Lockridge | 108/43 |
| 4,185,753 | A | * | 1/1980 | Leto | 206/233 |
| D256,292 | S | | 8/1980 | Cox | |
| 4,674,298 | A | | 6/1987 | Wimmershoff-Caplan | |
| 4,781,315 | A | * | 11/1988 | Nordskog | 224/165 |
| 4,824,140 | A | * | 4/1989 | Rankin | 281/6 |
| 4,836,428 | A | * | 6/1989 | Evans et al. | 224/240 |
| 4,903,250 | A | | 2/1990 | Cho | |
| 4,966,319 | A | | 10/1990 | Fleming | |
| D316,187 | S | * | 4/1991 | Rodgers | D3/106 |
| 5,127,545 | A | * | 7/1992 | French | 221/102 |
| D329,201 | S | * | 9/1992 | Barat | 224/165 |
| 5,350,061 | A | | 9/1994 | Gunn | |
| 5,531,481 | A | * | 7/1996 | Wiltshire | 281/44 |
| D377,913 | S | | 2/1997 | Cross | |
| 5,625,606 | A | | 4/1997 | Openiano | |

FOREIGN PATENT DOCUMENTS

| | | |
|---|---|---|
| WO | WO 95/02877 | 1/1995 |

* cited by examiner

*Primary Examiner*—Stephen K. Cronin
(74) *Attorney, Agent, or Firm*—Richard C. Litman

(57) ABSTRACT

A small, body mounted, non-obstructive, lidded, pad and pencil carrying case. The case is economical to manufacture, will not snag on clothing or other material, and provides covered support for a small pad of paper (such as those sold under the name Post-It™) and a writing instrument. The case is carefully sized to be just large enough to easily contain such a pad and, possibly, a small pen or pencil. In an alternate embodiment, the pen or pencil may be attached to an outer side of the case, using hook and loop fastener material such as Velcro™. The case is attached to a wristband, spring clip, or neck rope for supporting the case conveniently on a person's wrist, clothing, or about the neck, respectively.

7 Claims, 5 Drawing Sheets

WEARABLE CASE FOR WRITING MATERIALS

CROSS-REFERENCE TO RELATED APPLICATION

This application claims the benefit of U.S. Provisional Patent Application Serial No. 60/120,752, filed Feb. 18, 1999.

BACKGROUND OF THE INVENTION

1. Field of the Invention

The present invention relates to body mounted carrying cases. More specifically, the invention involves several embodiments of carrying cases for supporting small pads of paper and a writing instrument about a portion of a person's body.

2. Description of Related Art

Devices for mounting writing instruments and supplies, as well as devices for mounting articles to portions of the human body are known. What is missing from the related art, however, is a small, body mounted, non-obstructive, pad and pencil carrying case that: is economical to manufacture; will not snag on clothing or other material; and still provides support for a small pad of paper and a writing instrument.

Some designs of devices to support a writing/drawing instrument on a person's wrist are shown in the following design patents. U.S. Design Patent No. Des. 256,292, issued to Cox on Aug. 12, 1980, is directed to a wrist band pen holder, while U.S. Design Pat. No. Des. 377,913, issued to Cross on Feb. 11, 1997 discloses a slip-on wrist case for capsule components such as compasses or thermometers.

The following patents illustrate some cases for holding writing supplies or similar instruments. U.S. Pat. No. 259,076, issued to Bainbridge on Jun. 6, 1882, discloses a card case that holds stationary cards and may be placed in one's pocket. U.S. Pat. No. 362,106, issued to Pember et al. on May 3, 1887, describes a pocket writing case that includes compartments for ink, pens, pencils, pins, erasers, a pen-wiper, etc. U.S. Pat. No. 433,536, issued to Murdock on Aug. 5, 1890, discloses a combined slate and satchel containing an integral slate writing surface, writing implements, as well as other utensils useful to a student.

U.S. Pat. No. 5,350,061, issued to Gunn on Sep. 27, 1994, discusses container systems for school supplies.

The following patents disclose some devices for holding small articles (including writing instruments) about a person's wrist or neck. U.S. Pat. No. 4,674,298, issued to Wimmershoff-Caplan on Jun. 23, 1987, describes a pendant necklace integrated with a removable writing implement. U.S. Pat. No. 4,903,250, issued to Cho on Feb. 20, 1990, shows a wrist watch with a memo case. The memo case includes a small pad of paper mounted under a lid just adjacent to the watch display. U.S. Pat. No. 4,966,319, issued to Fleming on Oct. 30, 1990, discloses a small, orthodontal, carrying case designed to be worn about the neck. The case includes a lid with a snap-type fastener. U.S. Pat. No. 5,625,606, issued to Openiano on Apr. 29, 1997, shows a wristwatch and strap with a writing, probing or pointing instrument contained therein. International Publication No. WO 95/02877, published Jan. 26, 1995, is directed to an improved style of identification bracelet that includes slots for the insertion of written material.

None of the above inventions and patents, taken either singly or in combination, is seen to describe the instant invention as claimed. Thus a carrying case for supporting small pads of paper and a writing instrument about a person's wrist, neck or waist that solves the aforementioned problems is desired.

SUMMARY OF THE INVENTION

As described above, the present invention is directed to a small, body mounted, non-obstructive, lidded, pad and pencil carrying case that: is economical to manufacture; will not snag on clothing or other material; and also provides covered support for a small pad of paper (such as those sold under the name Post-It™) and a writing instrument. The case includes a main body portion that is attached to a wristband, neck rope, or spring clip for supporting the case conveniently on a person's wrist, about the neck, or attached to the clothing respectively. A lid covers the open top of the main body portion and includes a snap closure to hold the lid closed. The case is particularly suitable for home, office, school or personal use, by adults or children. As with the Post-It™ pads, the cases would come in a variety of matching colors such as purple, black, navy blue, red, yellow and green.

The case is designed to come in two sizes. Both the large sized case (for 2" by 3" Post-It™ pads) and the small size case (for 1½" by 2" Post-It™ pads) are carefully sized to be just large enough to easily contain the associated pad and, possibly, a small pen or pencil. In an alternate embodiment, the pen or pencil may be attached to an outer side of the case, using hook and loop fastener material such as Velcro™. The case is designed with curved edges and soft, plastic, skin-safe material to reduce the chance of snagging material or scratching one's skin.

The wristband embodiment includes four slots in the bottom of the main body portion for threading a flat wristband therethrough. The wrist band may be of any suitable length for children and adults, however, lengths of 8" (small), 12" (medium) and 16" (large) are envisioned. The ends of the wristband are connected using one of two fastener embodiments. In the first embodiment, one end of the wristband includes a first piece of hook and loop fastener material, while the second end of the wristband includes a second, mating piece of hook and loop fastener material. In a second embodiment, one end of the wristband includes a buckle for threading the second end of the wristband therethrough. The lid of the wristband embodiment may be integral with the main body portion, (being connected by a thin flexible portion of plastic that acts as a hinge) or may be attached to the main body portion using any suitable means.

The neck rope embodiment has a lid with both a planar portion as well as a cylindrical portion with an axial bore. Two apertures in the sides of the main body portion align with the axial bore in the lid. The neck rope is threaded through the two apertures and the axial bore to form a "pivot pin" for the lid. As with the wristband, the neck rope can be made any suitable length, however 22", 28" and 34" lengths are envisioned. The rope may be continuous (having the ends sewn or braided together after being routed through the two apertures and the axial bore), or may have its ends tied together in a simple knot.

The clip embodiment includes a spring clip attached to the bottom of the main body portion. The spring clip is adapted to attach to a belt or other piece of clothing.

Accordingly, it is a principal object of the invention to provide a wearable case for writing materials to eliminate valuable time wasted searching for a pad and pen or pencil.

It is another object of the invention to provide a carrying case design that can be easily manufactured.

It is a further object of the invention to provide a wearable carrying case that does not scratch the wearer's skin or snag their clothing.

Still another object of the invention is to provide the smallest possible size carrying case that can still hold standard sizes of commercially available, small paper pads.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to several embodiments of small, body mounted, non-obstructive, lidded, pad and pencil carrying cases. The cases provide covered support for a small pad of paper and a writing instrument, and are designed to be economical to manufacture while not snagging clothing or scratching other material.

Figure 1:
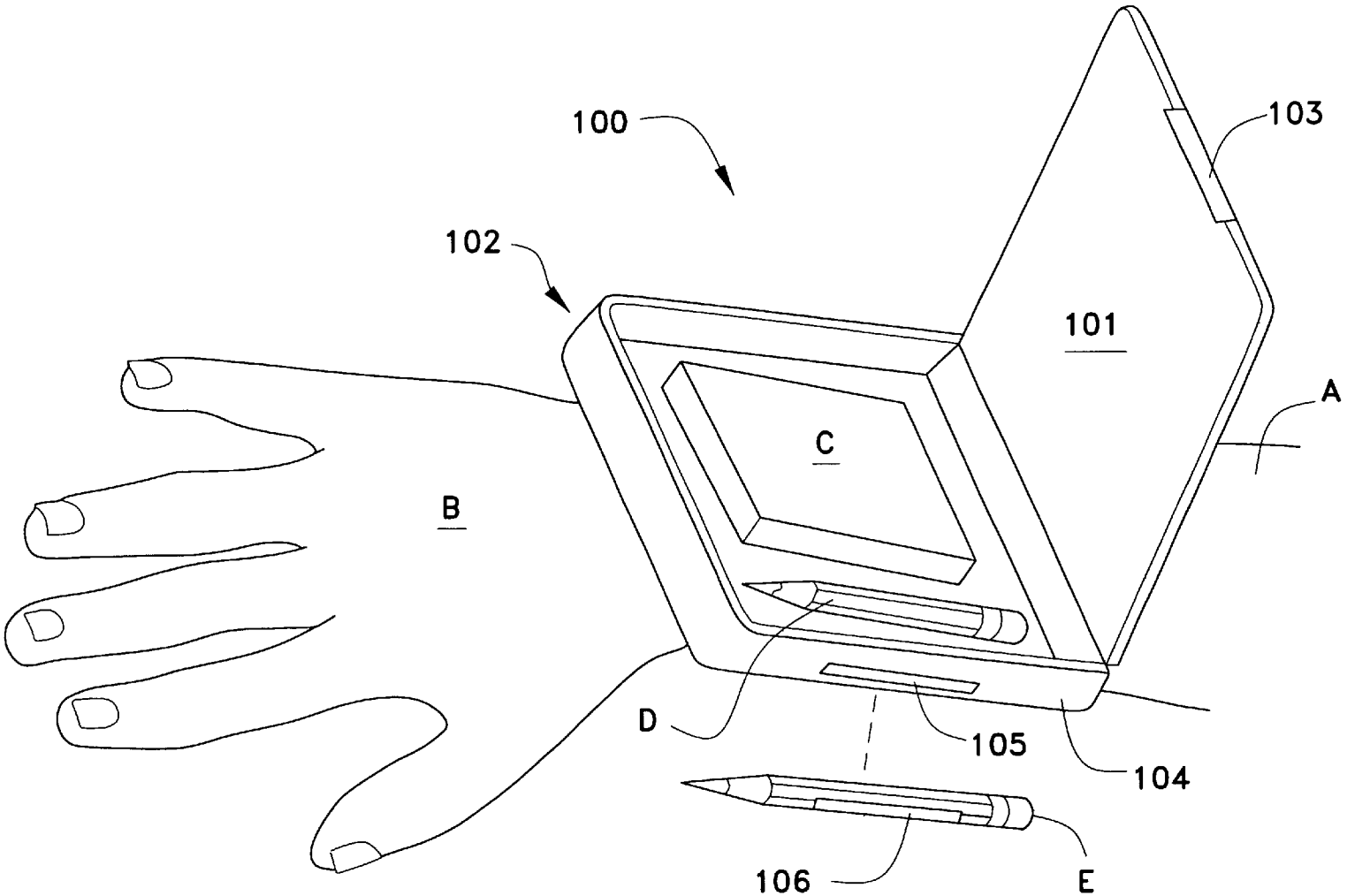
FIG. 1 is an environmental perspective view of a wrist case, open, for writing instruments according to a first embodiment of the present invention.

In FIG. 1, a first wristband embodiment 100 of the case is shown strapped to a person's wrist A, proximate their hand B. A lid 101 covers an open top of the main body portion 102 and includes a snap closure 103 to hold the lid closed. The lid 101 of the wristband embodiment 100 may be integral with the main body portion, (being connected by a thin flexible portion of plastic that acts as a hinge) or may be attached to the main body portion using any suitable hinging means. A pad of paper C and a pencil D are shown inside of the main body portion 102. As previously discussed, the case is designed to come in two sizes: a large sized case (for 2" by 3" Post-It™ pads); and a small size case (for 1½ by 2" Post-It™ pads). Both cases are carefully sized to be just large enough to easily contain their associated pad and a small pen or pencil.

In an alternate embodiment, the pen or pencil (shown as E) may be removably attached to an outer surface of one side 104 of the main body portion. The removable attachment means includes a first piece 105 of hook and loop fastener material (such as Velcro™) that is attached to the outer surface of one side 104 of the main body portion 102, and a second mating piece 106 of hook and loop fastener material that is attached to the pen or pencil E.

Figure 2:
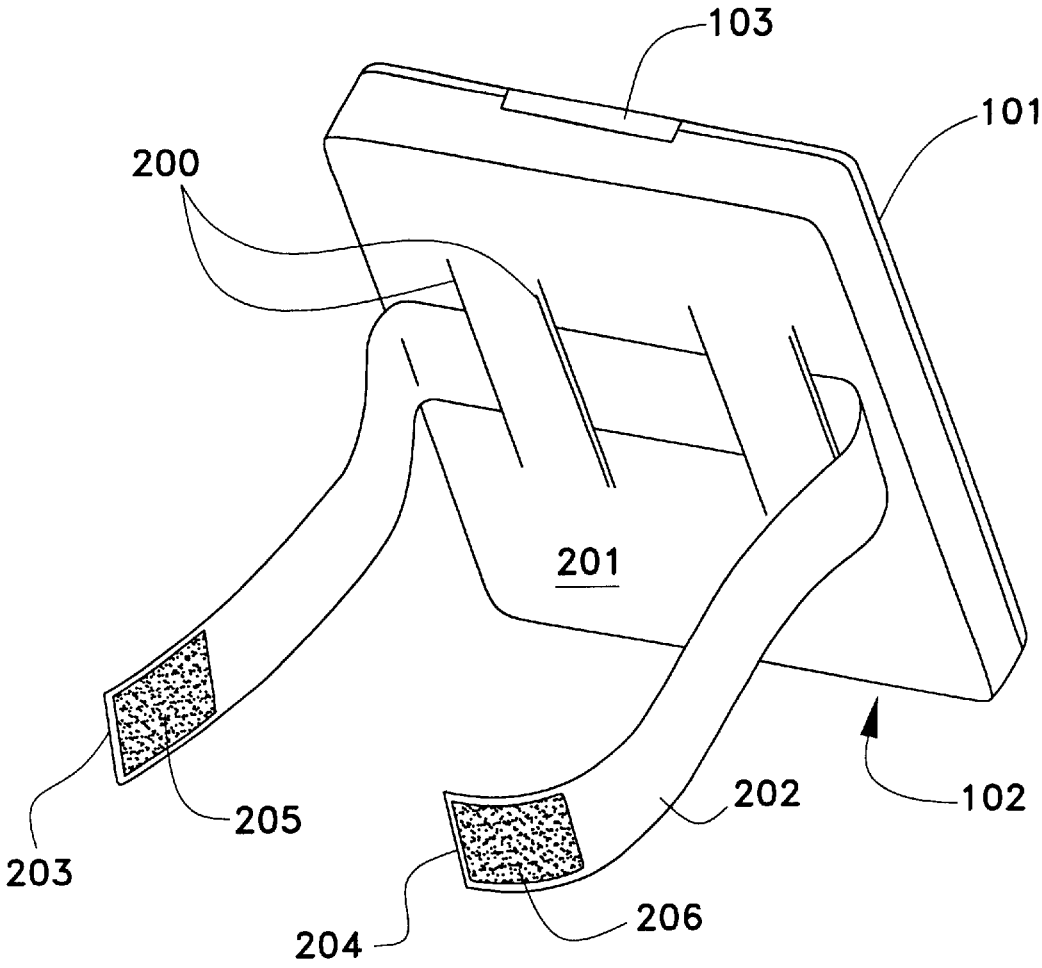
FIG. 2 is a bottom perspective view of the case of FIG. 1, closed, and showing a wrist band with a first embodiment of connecting means, while also showing the band's attachment to the bottom of the case.

FIG. 2 is a bottom perspective view of the case of FIG. 1, showing the four slots 200 in the bottom 201 of the main body portion 102. A flat wristband 202 is threaded through the slots 200. The ends 203 and 204 of the wristband 202 are connected using one of two fastener embodiments. In the first embodiment (shown in FIG. 2), a first end 203 of the wristband 202 includes a first piece 205 of hook and loop fastener material, while the second end 204 of the wristband includes a second, mating piece 206 of hook and loop fastener material.

Figure 3:
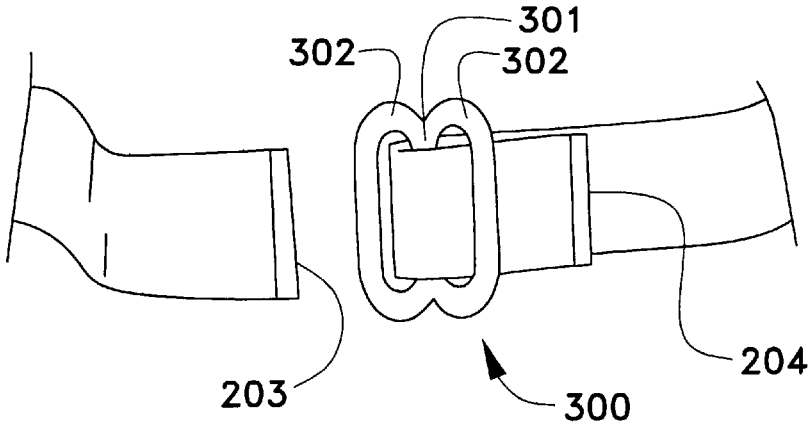
FIG. 3 is a perspective view of a second embodiment of the connecting means of the strap.

To secure the case to one's wrist, the two ends 203 and 204 of the wristband 202 are drawn towards each other to remove any slack, and the two pieces of hook and loop fastener material 205 and 206 are pressed against each other. In a second embodiment, (shown in FIG. 3) the second end 204 of the wristband is attached to a buckle 300 for threading the first 203 end of the wristband therethrough. The buckle includes a central bar 301 and two outer bars 302. The second end 204 of the wristband is wrapped around central bar 301 and attached to itself (by sewing or any suitable means). To secure the case to one's wrist, end 203 is threaded between one of the outer bars 302 and the central bar 301 and then between the other outer bar 302 and the central bar 301. The two ends 203 and 204 of the wristband 202 are then pulled away from each other to remove any slack.

Figure 4:
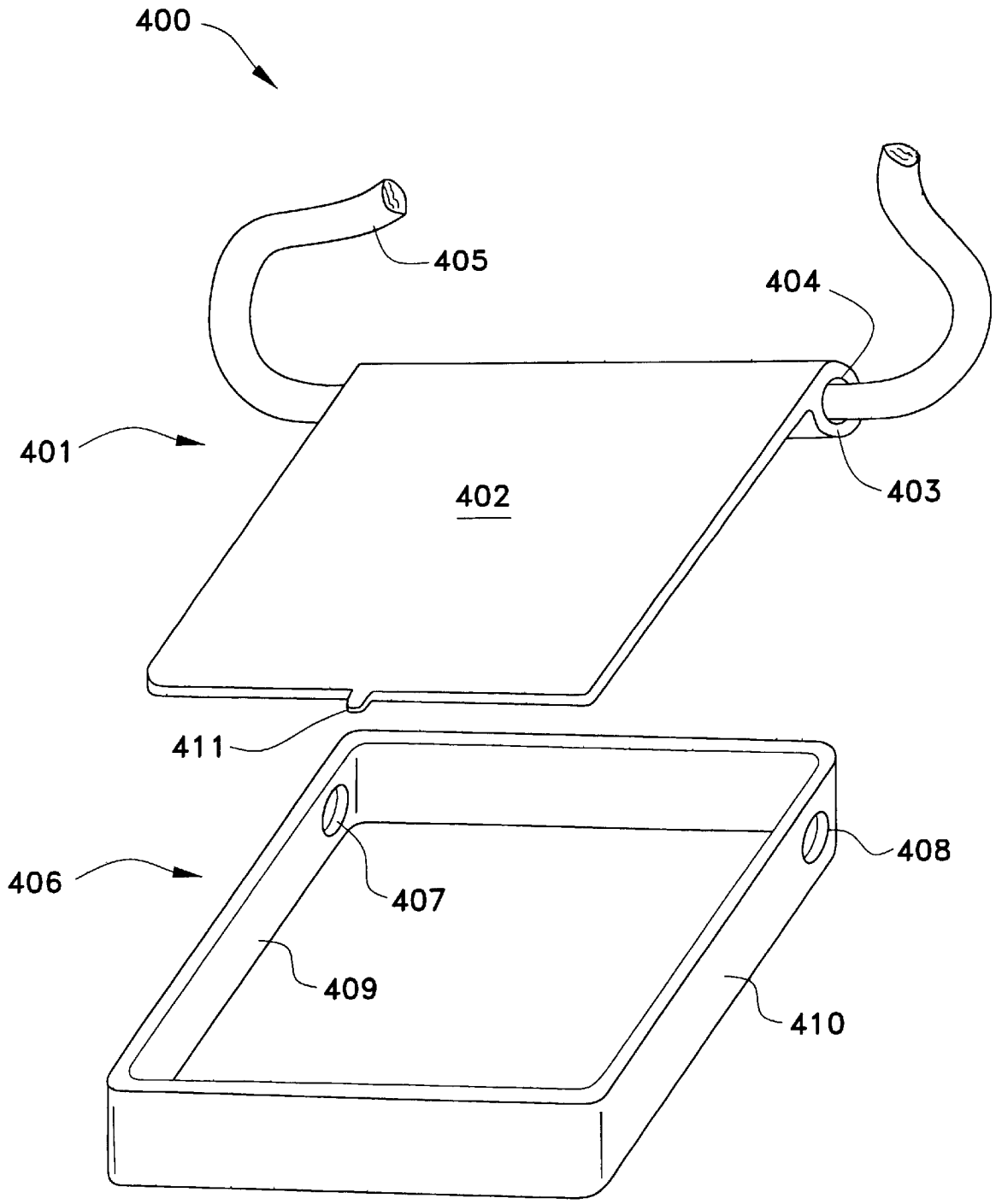
FIG. 4 is a perspective view of a neck worn case for writing instruments according to a second embodiment of the present invention, showing the lid disconnected from the case to show details thereof.

In FIG. 4, the neck rope embodiment 400 of the case is shown. The neck rope embodiment 400 includes a lid 401 (including a snap closure 411 to hold the lid closed) with both a planar portion 402 as well as a cylindrical portion 403. The cylindrical portion 403 has an axial bore 404 for threading neck rope 405 therethrough. Two apertures 407 and 408 are provided in two of the sides, (409 and 410) of the main body portion 406. When the lid 401 is properly installed on the main body portion 406, apertures 407 and 408 align with the axial bore 404 in the lid 401. The neck rope 405 is then threaded through the two apertures 407 and 408 and the axial bore 404. In this way, the neck rope 405 forms a "pivot pin" for the lid 401, allowing lid 401 to pivot between a closed and an open position.

Figure 5:
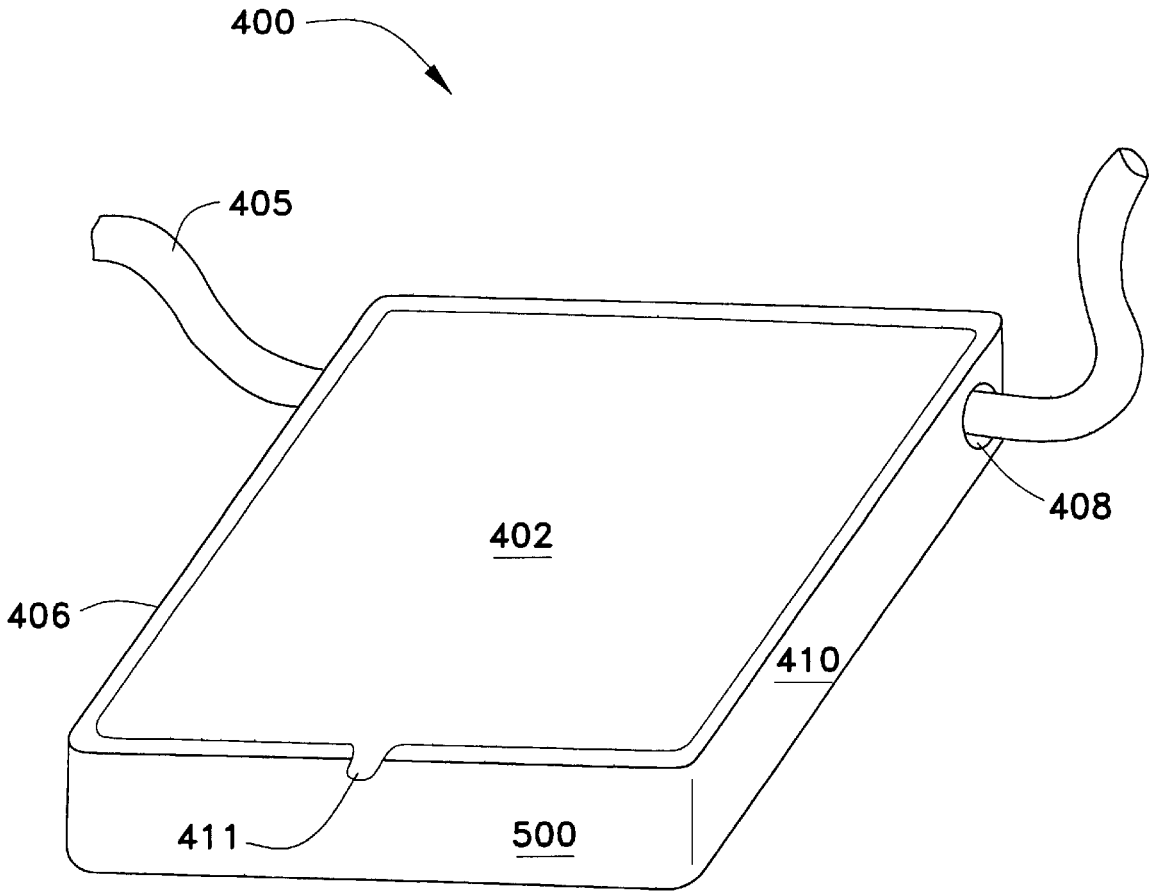
FIG. 5 is a perspective view of the neck worn case of FIG. 4, showing the lid attached to the case, and closed.

As shown in FIG. 5, snap closure 411 engages side 500 of the main body portion 406 to hold lid 401 in the closed position. The rope 405 may be continuous, in which case the ends are sewn or braided together after the rope 405 has been routed through the two apertures and the axial bore. In another embodiment, the rope 405 may have its ends tied together in a simple knot. The neck rope 405 may be made any suitable length, although 22" (small), 28" (medium) and 34" (large) are preferred.

Figure 6:
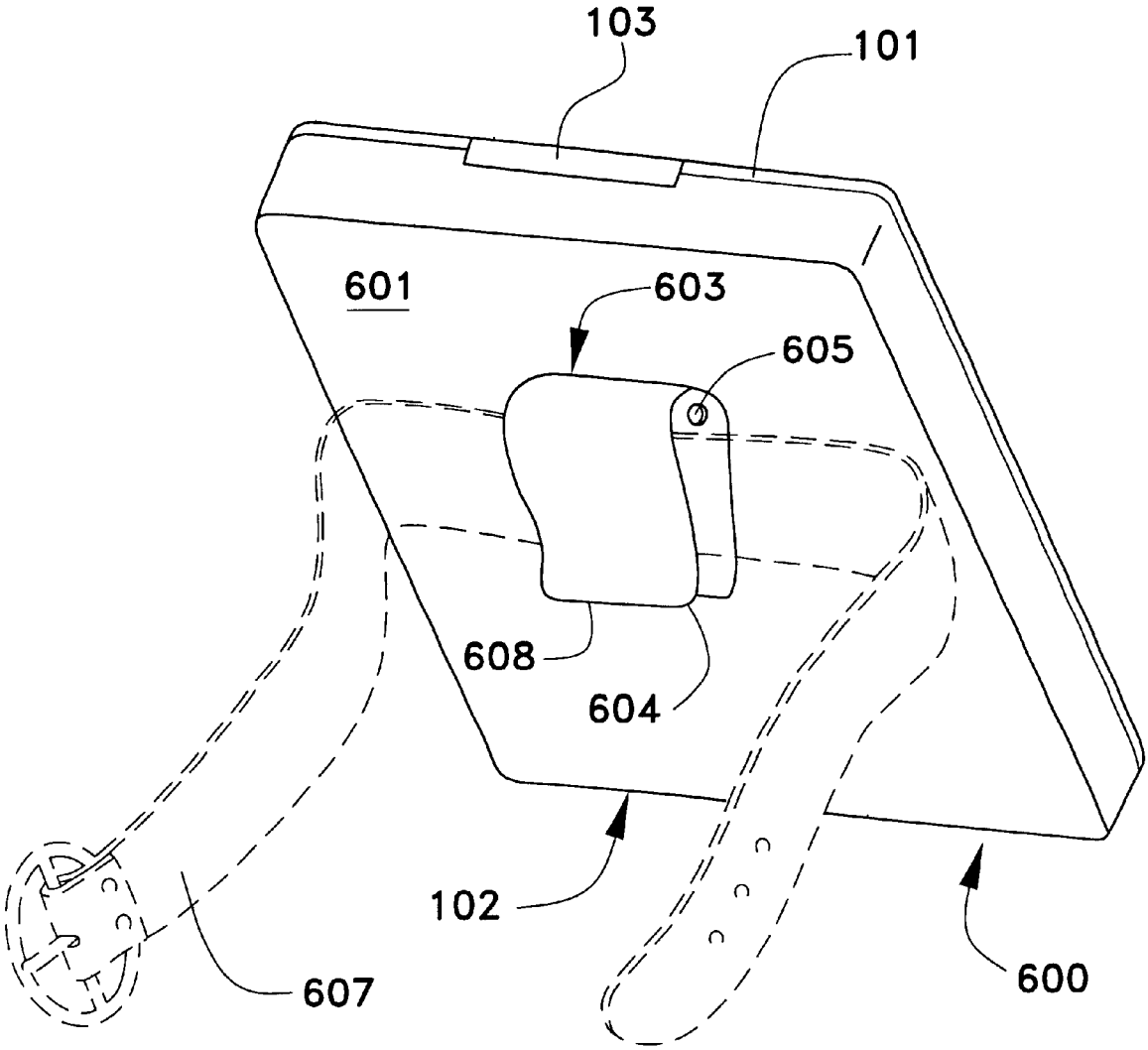
FIG. 6 is an environmental, perspective view of a waist worn case, showing the spring clip attached to a belt.

FIG. 6 shows a clip embodiment 600. The bottom 601 of the main body portion 102 has an attached spring clip 603. The spring clip 603 is U-shaped and is composed of metal or other suitable materials. The corners 604 of the spring clip are rounded for comfort and to avoid snagging clothing. The spring clip 603 may be attached to the bottom 102 by one or more rivets 605 or other suitable fasteners. The spring clip 603 is adapted to hook over a belt 607 worn around the waist in the usual manner. The spring clip 603 may also be used to attach the case to a pocket or other parts of a person's clothing. Preferably the ends 608 of the U are directed away from the snap closure 103 and toward the hinge. This permits the case to be opened in a vertical position without the contents falling out.

All of the above described embodiments of the case are suitable for home, office, school or personal use, by adults or children. The cases come in a variety of matching colors such as purple, black, navy blue, red, yellow and green to match commercially available colors of the paper pads. The cases are designed with curved edges, rounded corners and soft, plastic, skin-safe material to reduce the chance of snagging material or scratching a person's skin. These materials are well known and the cases can be formed using several different methods such as blow or injection molding.

It is to be understood that the present invention is not limited to the embodiments described above, but encompasses any and all embodiments within the scope of the following claims.

I claim:

1. A wearable case for a pad of paper and writing instruments, said case comprising:

a main body portion having four sides, a bottom having four slots defined therein, and an open top;

a lid pivotally connected to said main body and being dimensioned and configured for covering said open top; and a flat strap, said strap being threaded through said four slots, for supporting said main body portion on the wrist or neck of a person;

said strap is dimensioned and configured to securely hold said main body portion to a person's wrist.

2. The wearable case for writing instruments according to claim 1, wherein:

said strap has a first and a second end;

said first end of said strap has a buckle attached thereto;

said second end of said strap engages said buckle to thereby attach said case to a person's wrist.

3. The wearable case for writing instruments according to claim 1, wherein:

said strap has a first and a second end;

said first end of said strap has a first piece of hook and loop fastener material attached thereto;

said second end of said strap has a second piece of hook and loop fastener material attached thereto;

said first piece of hook and loop fastener material mates with said second piece of hook and loop fastener material to thereby attach said case to a person's wrist.

4. The wearable case for writing instruments according to claim 1, wherein said lid further comprises a snap closure that engages an outer surface of one of said four sides of said main body portion in order to maintain said lid in a closed position.

5. The wearable case for writing instruments according to claim 1, wherein said four sides and said bottom of said main body portion intersect to define rounded corners.

6. The wearable case for writing instruments according to claim 1, wherein said main body portion and said lid are constructed-of soft skin-safe plastic.

7. A wearable case for a pad of paper and writing instruments, said case comprising:

a main body portion having four sides, a bottom having four slots defined therein, and an open top;

a lid pivotally connected to said main body and being dimensioned and configured for covering said open top;

a flat strap, said strap being threaded through said four slots, for supporting said main body portion on the wrist or neck of a person;

said strap is dimensioned and configured to securely hold said main body portion to a person's wrist; and a writing instrument located inside of said main body portion.

* * * * *